US006234762B1

(12) United States Patent
Lucas

(10) Patent No.: US 6,234,762 B1
(45) Date of Patent: May 22, 2001

(54) REVERSIBLE VENTURI-EFFECT PUMP

(75) Inventor: Derick Ross Lucas, Main Beach (AU)

(73) Assignee: Futurepump Pty. Ltd., Queensland (AU)

( * ) Notice: Subject to any disclaimer, the term of this patent is extended or adjusted under 35 U.S.C. 154(b) by 0 days.

(21) Appl. No.: 09/254,345

(22) PCT Filed: Sep. 8, 1997

(86) PCT No.: PCT/AU97/00583

§ 371 Date: Mar. 5, 1999

§ 102(e) Date: Mar. 5, 1999

(87) PCT Pub. No.: WO98/10194

PCT Pub. Date: Mar. 12, 1998

(30) Foreign Application Priority Data

Sep. 6, 1996 (AU) ..... PO2154

(51) Int. Cl.[7] ..... F04F 1/06

(52) U.S. Cl. ..... 417/126; 417/131; 137/565.22

(58) Field of Search ..... 417/126, 118, 417/131, 134; 137/212, 565.22, 892, 893, 890

(56) References Cited

U.S. PATENT DOCUMENTS 3,861,830 * 1/1975 Johnson ..... 417/149
4,029,066 * 6/1977 Iwasa ..... 123/274
4,335,062 * 6/1982 Kobayashi ..... 261/44.8
4,511,291 * 4/1985 Quates, Sr. et al. ..... 406/128
5,007,803 * 4/1991 DiVito et al. ..... 417/137
5,033,914 * 7/1991 Wuertele et al. ..... 406/109
5,427,505 * 6/1995 Payne ..... 417/149
5,615,716 * 4/1997 Akazawa ..... 141/91
5,938,408 * 8/1999 Krichbaum ..... 417/87

* cited by examiner

*Primary Examiner*—Charles G. Freay
(74) *Attorney, Agent, or Firm*—Young & Thompson

(57) ABSTRACT

A pump for both filling and emptying containers with liquids, flowable solids, etc. has a body which is screwed into a bung hole in the top wall of the container. According to the state of evacuation or pressurization produced in the container by the pump, "liquid" will enter or leave the container via pipe passing through the body of the pump. The motive power for the pump is a compressed air source which provides air to a venturi positioned in a passage connecting the interior of the container with the exterior via vented chamber. Air flowing through air ports in the venturi generates a vortex which creates air flow through passage. By turning handle, the venturi may be rotated so as to reverse its orientation and thus reverse the direction of air flow to either pressurize or evacuate the container. Alternatively, a pair of oppositely-directed venturis selectively connectable to air passage may be used to perform the emptying and filling functions.

11 Claims, 7 Drawing Sheets

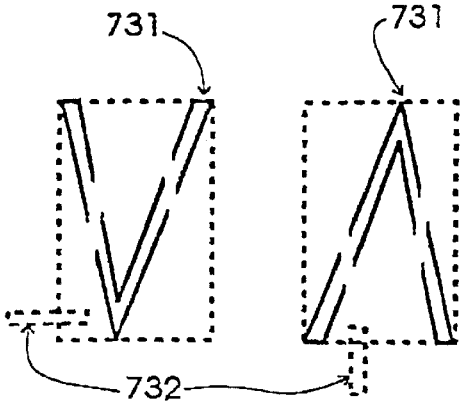
FIG. 16
FIG. 17
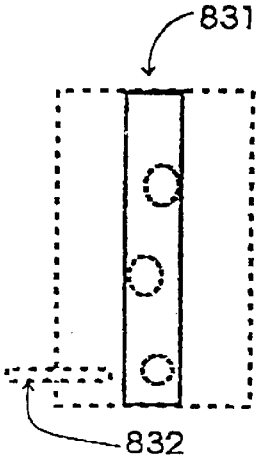
FIG. 18
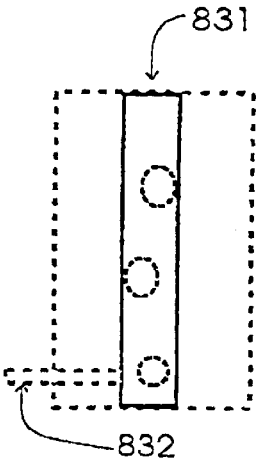
FIG. 19
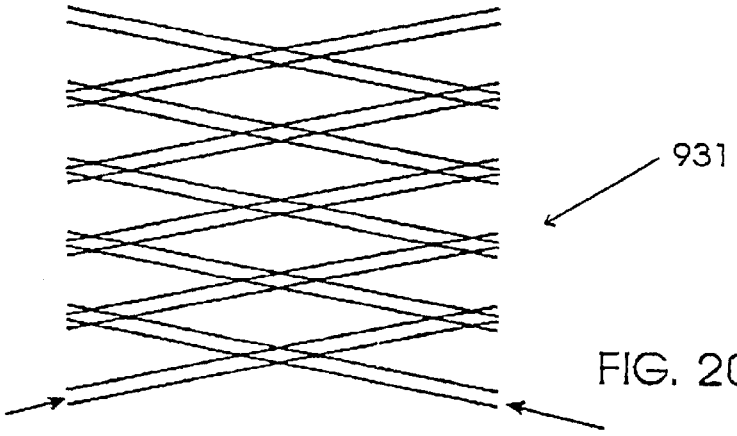
FIG. 20
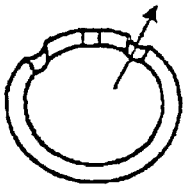
FIG. 21
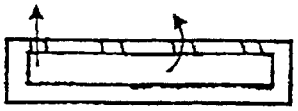
FIG. 22
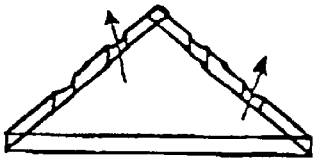
FIG. 23

REVERSIBLE VENTURI-EFFECT PUMP

This application is a 371 of PCT/AU97/00583, filed Sep. 8, 1997.

BACKGROUND OF THE INVENTION

1. Field of the Invention

THIS INVENTION relates to a pump.

The pump is particularly suitable for, but not limited to, a pump for liquids.

The term "liquid" shall be used throughout the specification to include liquids, slurries, flowable powders, flowable granular materials and the like.

The term "container" throughout the specification shall include containers, tins, drums, barrels, tanks and the like.

2. Prior Art

Many different types of pumps have been used and proposed for pumping liquids into, or out of, containers. Examples include gerotor pumps, gear pumps, Roots pumps, vane pumps, and the like.

All of these pumps have the major limitation that they require moving parts which are subject to wear, leading to loss of efficiency and requiring periodic replacement.

In an effort to overcome the use of moving parts, venturi-like pumps have been developed—U.S. Pat. Nos. 5,329,982 (PAYNE) and 3,861,830 (JOHNSON). These pumps employ a fixed venturi and valve(s) to direct pressurized air or vacuum to control the flow of liquid into, or out of, the container. This requires both a pressure source and a vacuum source to operate the pumps.

SUMMARY OF THE INVENTION

It is an object of the present invention to provide a pump for liquids which has no moving parts.

It is a preferred object of the present invention to provide a pump which can pump liquids both into, and out of, containers.

It is a further preferred object of the present invention to provide a pump which can operate using a single source of compressed air.

Other preferred objects of the present invention will become apparent from the following description.

In one aspect, the present invention resides in a pump suitable for pumping liquids into, or out of, a container, including:

a body;

means to sealably engage the body with an inlet hole of the container;

liquid passage means in the body operably connectable to the interior of the container and to the exterior of the body;

an air passage through the body operably connectable to the interior of the container;

a venturi means in the air passage having a plurality of air ports operable to generate a vortex in the air passage; and compressed air passage means to connect the air ports to a source of compressed air (or gas);

so arranged that:

the venturi means is movably mounted in the air passage to selectively reverse the air flow through the air passage to either at least partially evacuate, or pressurize, the container, to pump the liquid into, or out of, the container.

Preferably, the venturi means is mounted in a ball, selectively rotatable by a handle, in the manner of the ball of a ball valve.

In a second aspect, the present invention resides in a pump suitable for pumping liquids into, or out of, a container, including:

a body;

means to sealably engage the body with an inlet hole of the container;

liquid passage means in the body operably connectable to the interior of the container and to the exterior of the body;

an air passage through the body operably connectable to the interior of the container;

a pair of venturi means in the air passage, each venturi means having a plurality of air ports operable to generate a vortex in the air passage, the venturi means being arranged to cause respective air flow through the passage in opposite directions; and compressed air passage means to selectively connect the air ports of one of the venturi means to a source of compressed air (or gas), so arranged that:

the venturi means are selectively connected to the source of compressed air to selectively reverse the air flow through the air passage to either at least partially evacuate, or pressurize, the container to pump the liquid into, or out of, the container.

Preferably, float means are provided to selectively close the air passage, and thereby shut off the pump, when the level of the liquid in the container exceeds a preset limit.

Preferably, the or each venturi means has a plurality of air ports spaced around and/or along the air passage to generate the vortex in the air passage, to generate the air flow through the air passage, and thereby pressurize or evacuate the drum. The number and location of the air ports may be dependent on the pressure of the compressed air and on the nature of the liquids to be pumped.

The venturis may be designed to highly multiply the pressure of the air from the compressed air source, eg., by up to 50–100 times.

BRIEF DESCRIPTION OF THE DRAWINGS

To enable the invention to be fully understood, preferred embodiments will now be described with reference to the accompanying drawings in which:

FIGS. 16 to 23 are further embodiments of venturi suitable for the pump.

DETAILED DESCRIPTION OF THE PREFERRED EMBODIMENTS

Figure 1:
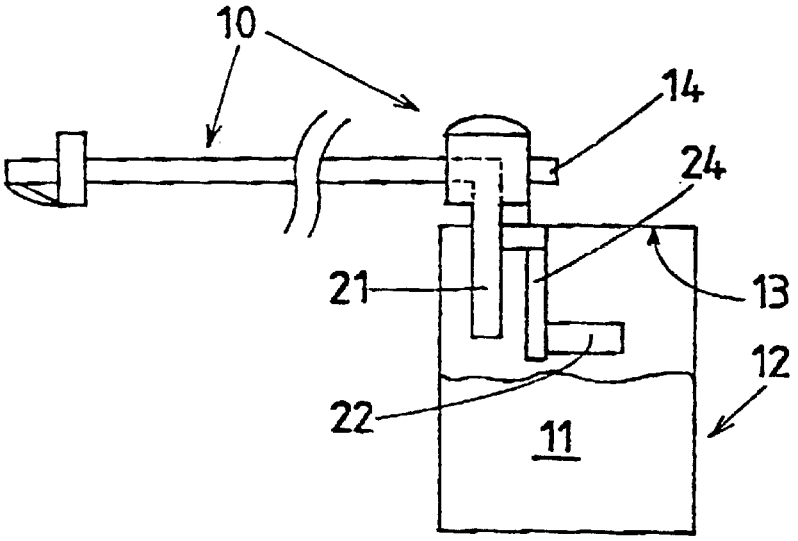
FIG. 1 is a schematic view showing the installation of the pump in a drum.

Referring to FIG. 1, the pump 10 is adapted to pump liquids 11 into, or out of, a drum 12, the small bung hole 13 of which is closed. The pump 10 is screw-threadably engaged in the inlet, or large bung hole 15 of the drum 12. The pump 10 is connected to a source of compressed air 14 capable of applying a relatively large volume of air, eg., at 35 kPa (5 psi) or higher.

Figure 4:
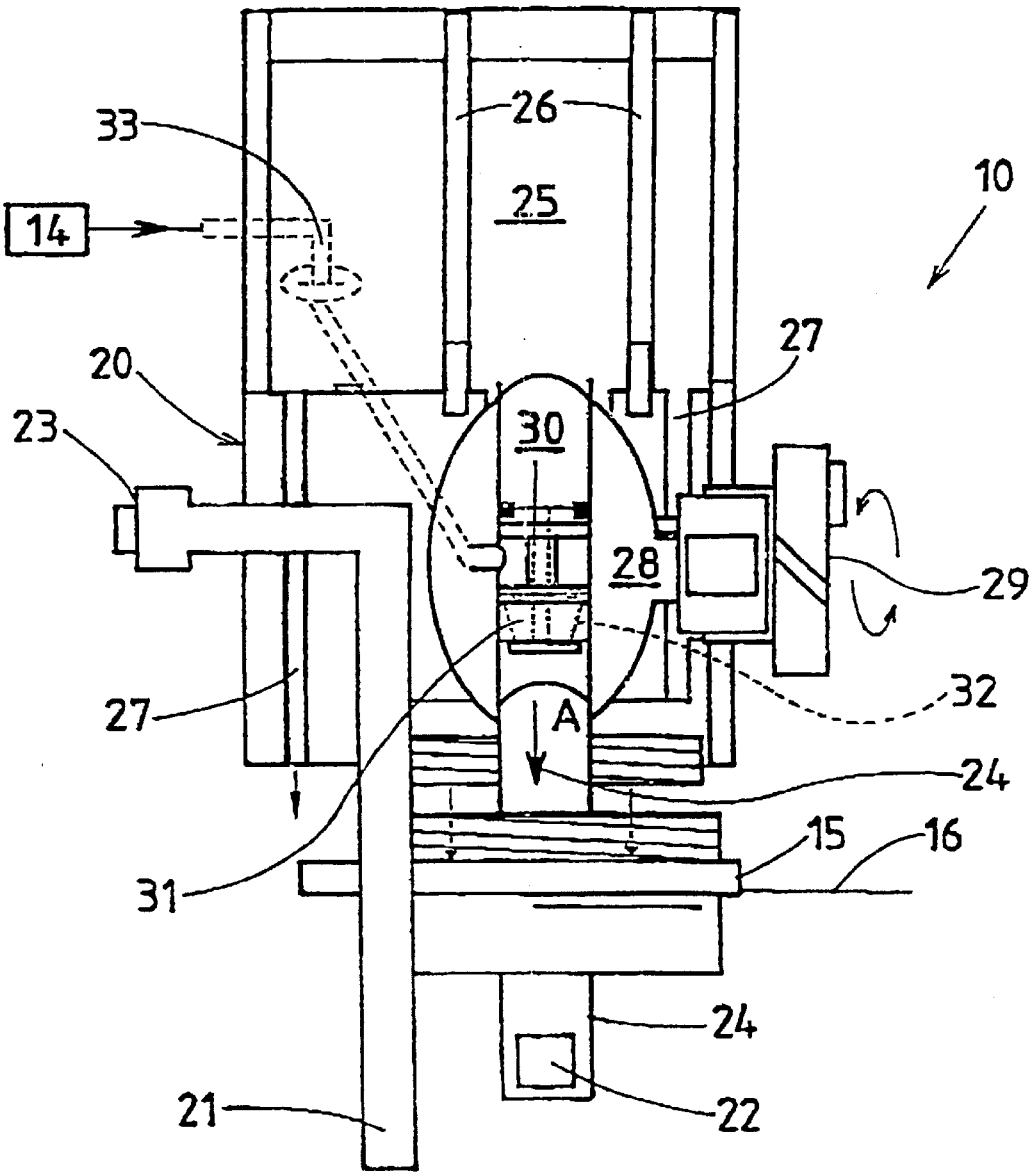
FIG. 4 is a part-sectional side view of a first embodiment of the pump.

Referring to FIG. 4, the pump 10 has a body 20 screw-threadably engaged in the large bung hole 15 in the top wall 16 of the drum 12. A liquids pipe 21 passes through the body and extends into the interior of the drum 12, approximately 15 mm (6 inches) below a float valve 22 to be hereinafter described. The liquids pipe 21 has a connector 23 for connection to a hose or pipe, not shown.

An air passage 24 to the body 20 of the pump is operably connected to the interior of the drum 12 and to an air chamber 25 which in turn is connected via holes in baffles 26 to venting ports 27 which open to the underside of the pump body. A ball 28, similar to the ball in a ball valve, is rotatably mounted in the air passage 24 and is selectively rotatable by a handle 29. An air passage 30 through the ball is operably connected with the air passage 24 and a venturi unit 31 is sealably engaged in the air passage 30. Air ports 32 are provided in the venturi unit 31 to generate a vortex in the passages 30, 24 to magnify the pressure of compressed air from a source, not shown, connected to the venturi unit 31 via a compressed air passage 33.

Figure 2:
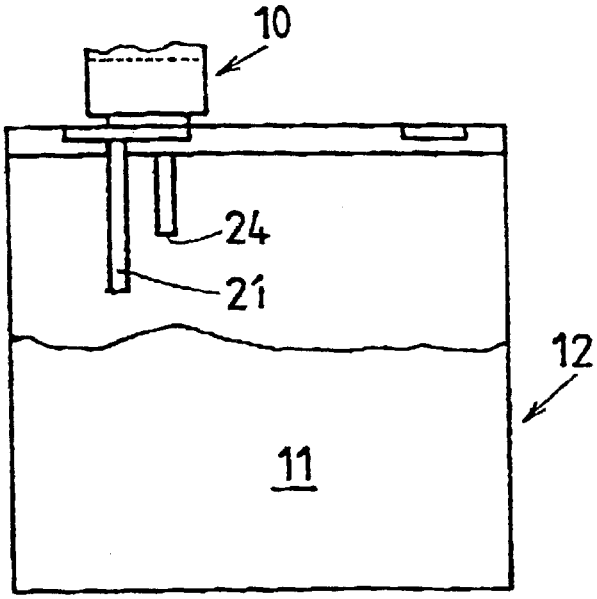
FIG. 2 is schematic view of the portion of the pump within the container.
Figure 3:
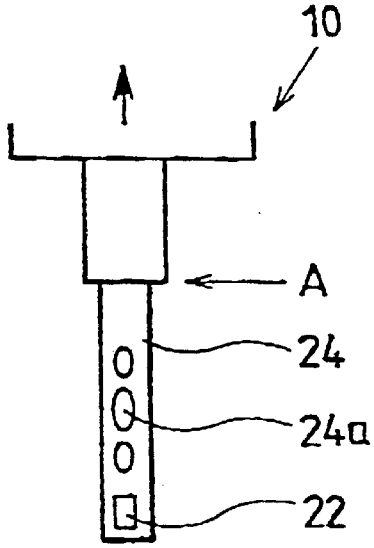
FIG. 3 is a schematic side view of the liquid passage/float valve assembly within the container.

The float valve 22 (see FIGS. 2 and 3) is mounted below the air passage 24 and is operable, when the level of the liquid 11 in the drum 12 reaches a preset limit A above holes 24*a*, to close off the air passage 24.

In the embodiment shown in FIG. 4, compressed air pumped through the air ports 32 will generate a vortex, which in turn generates an air flow in the air passages 30, 24 in the direction of arrow A to pressurize the interior of the drum 12. This causes the liquid 11 to flow through the liquid pipe 21 and be pumped out of the drum. By rotating the handle 29 to reverse the direction of the venturi unit 31, air will be caused to flow through air passages 24, 30 in the direction opposite to arrow A and the interior of the drum 12 will be at least partially evacuated to enable liquid to be drawn into the drum 12 via the liquid pipe 21.

As the air ports 32 can magnify the pressure of the compressed air, supplied by the compressed air passage 33, eg., by a multiple of up to 50, only a very low pressure air source 14 is required, eg., typically 35 kpa. Such an air source will typically be found on an earth-moving vehicle or military vehicle, and so the pump 10 is particularly suitable for pumping diesel, petroleum, lubricating oil, hydraulic oil, or coolant, from drums to supply the requirements of the engine, transmission or hydraulic equipment of the vehicle.

While the pump 10 is operating, there are no moving parts, the only parts ever being moved being the handle 29 and the ball 28 when the pump is being configured to either pump the liquids into, or out of, the drum 12.

When the float valve 22 closes the air passage 24, the vortex effect is shut off and only the pressure of the incoming compressed air is applied to the top of the float valve. This prevents the drum 12 from becoming over-filled.

Figure 5:
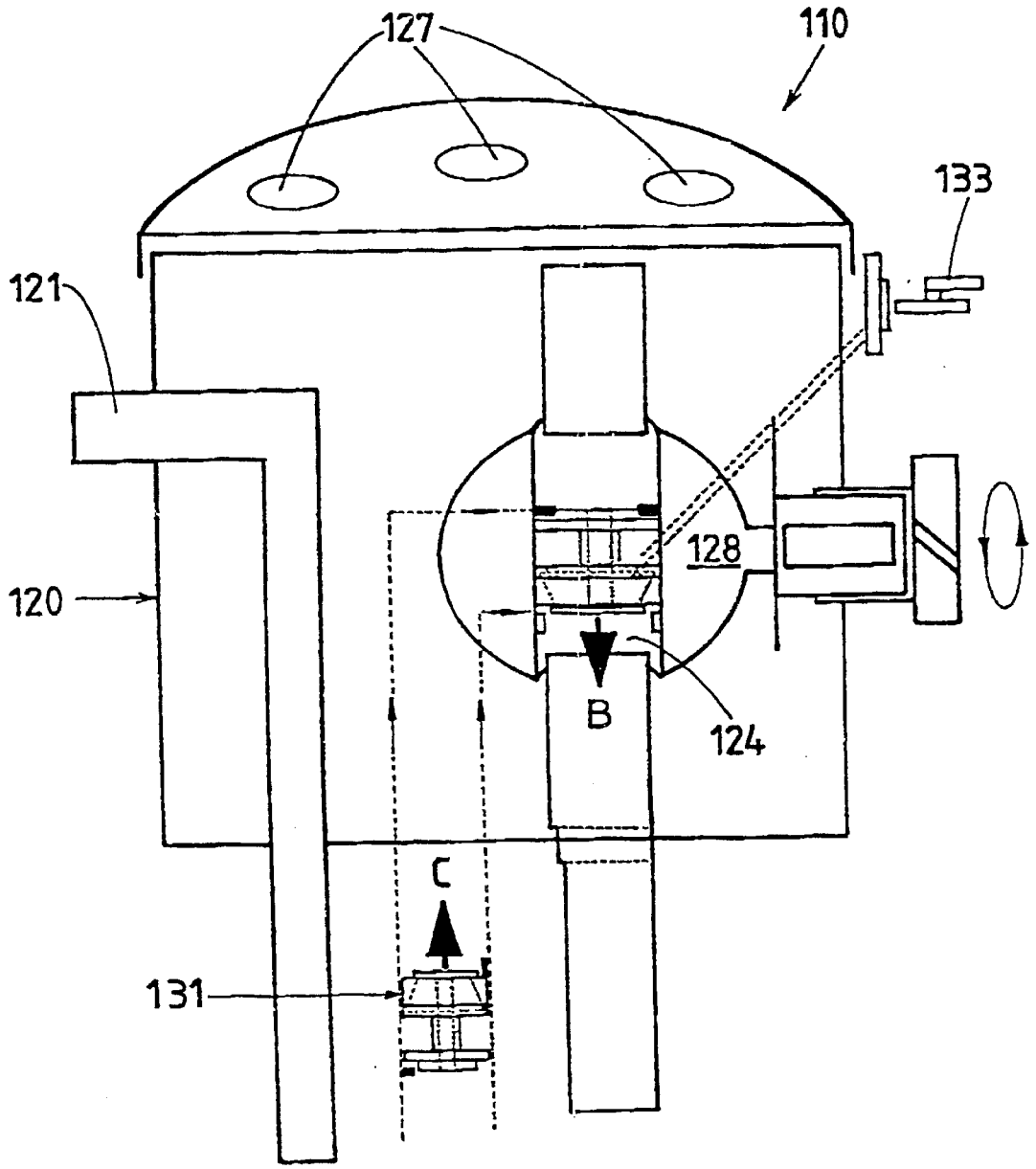
FIG. 5 is a schematic side view of a modified version of the pump.

In the embodiment of FIG. 5, the pump 110 has venting ports 127 at the top of the body 20 and the arrangement of the compressed air passage 133 has been modified. The large arrows B and C show the direction of the air flow through the venturi unit 131 in its alternative positions.

Figure 6:
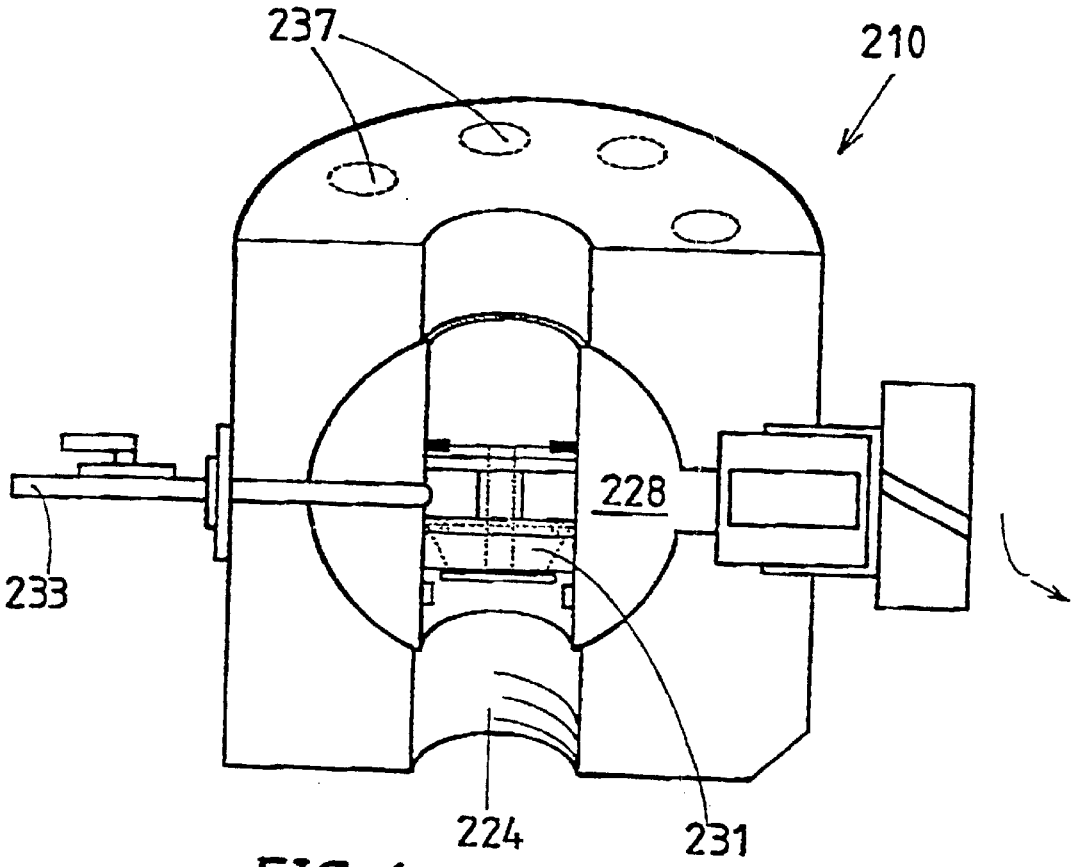
FIG. 6 is a similar view of a further modified version of the pump, parts being omitted for clarity.
Figure 7:
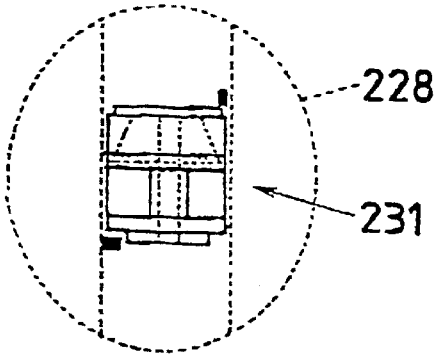
FIG. 7 shows the venturi of FIG. 4 in the reverse direction.

The pump 210 of FIG. 6 generally similar to the pump 110 with a further modification to the compressed air passage 233. FIG. 7 shows the venturi unit 231 in the alternative position to that shown in FIG. 6.

In the embodiments shown in FIGS. 4, 5 and 6, 7, there is a single venturi unit 31, 131, 231, which is mounted in the ball 28, 128, 228 to enable the direction of the air flow through the air passage 24, 124, 224 to be reversed, to enable the pumps to pump the liquids into, or out of, the drum 12. In the embodiments shown in FIGS. 8 to 10, the pumps 310, 410, 510, each incorporate a pair of venturi units, oppositely arranged, to which the compressed air is selectively directed.

Figure 8:
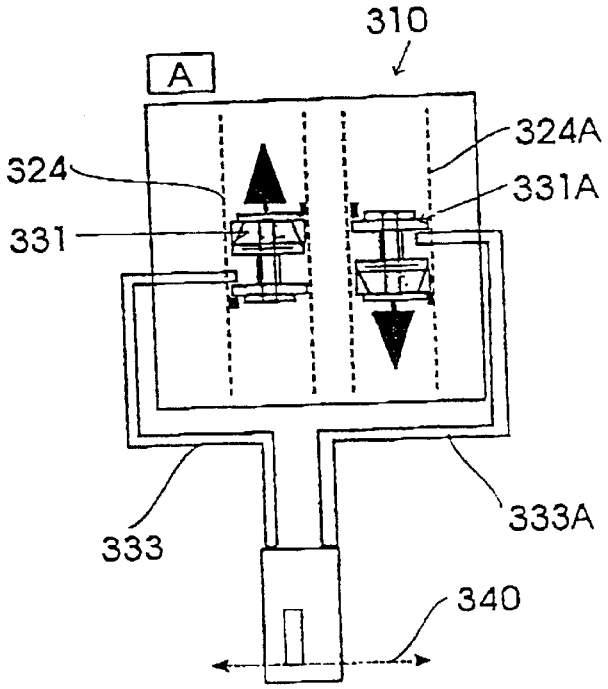
FIGS. 8 to 10 are schematic views showing second to fourth embodiments of the pump.

In the pump 310 of FIG. 8, the venturi units 331, 331A are oppositely arranged in respective air passages 324, 324A and the compressed air is selectively directed to either venturi unit via respective compressed air passages 333, 333A via a valve 340. Depending on which venturi unit is receiving the compressed air, the pump will either pump air into, or out of, the drum 12.

Figure 9:
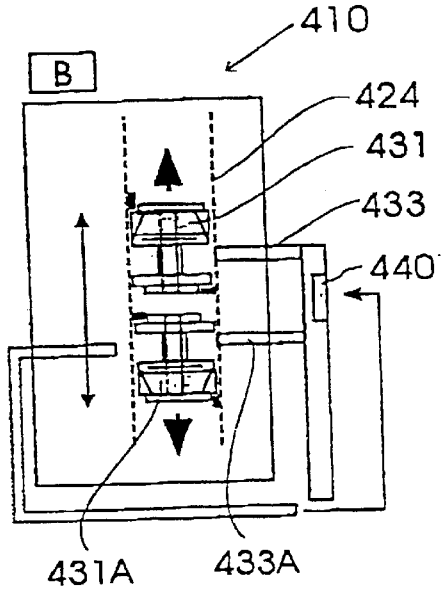

In the embodiment of FIG. 9, the pump 410 has the two venturi units 431, 431A oppositely arranged in the single air passage 424 in a slide jacket, where the venturi units 431, 431A are moved up and down (or left to right) to selectively be aligned with the compressed air passages 433, 433A, a gate valve 440 selectively directing the compressed air to the passages.

Figure 10:
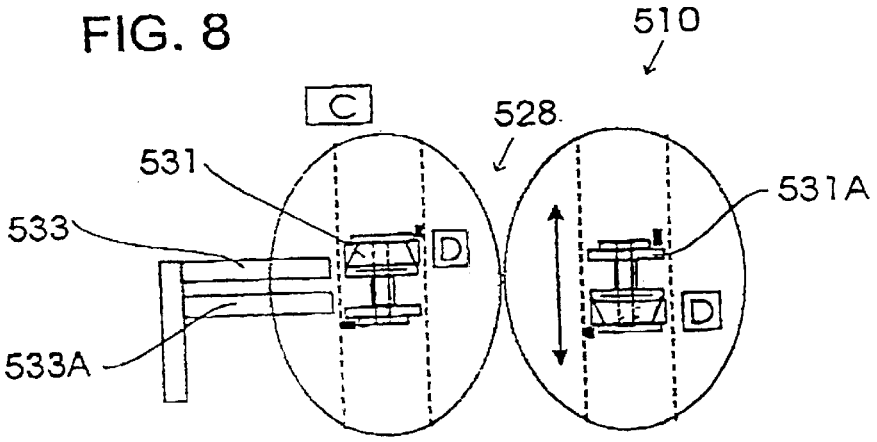

In pump 510 of FIG. 10, the ball 528 has compressed air passages 533, 533A having a common feed pipe. As the ball 528 is rotated, the bodies of the venturi units 531, 531A seals the opposing compressed air passages 533A, 533 to control the air flow through the air passage 524.

Figure 11:
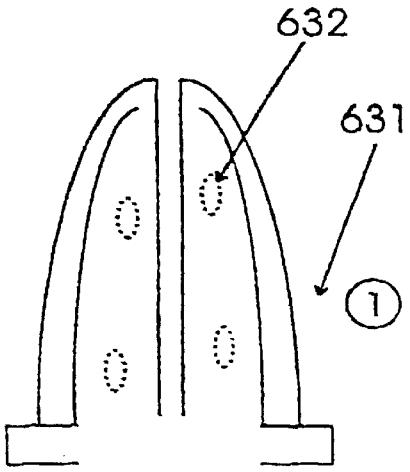
FIGS. 11 to 13 are schematic side, top and bottom views of an alternative embodiment of a venturi.
Figure 12:
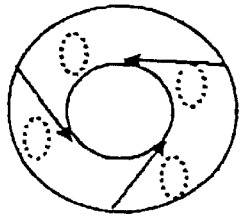
Figure 13:
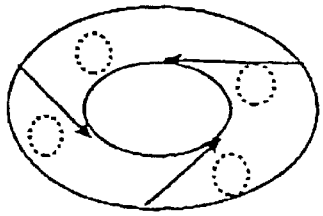

Referring to FIGS. 11 to 13, these show a cross-sectional view, top view and bottom view of a hollow cone venturi unit 631, having angle-drilled air ports 632. It should be noted that the angle of the hollow cone, the number and inclination of the air ports 632 may be varied, and that the holes in the venturi may not necessarily be circuit, but may be oblong or similar shape to produce a vortex. The configuration of the venturi may be inverted (i.e., concave or convex) to achieve the same result.

Figure 14:
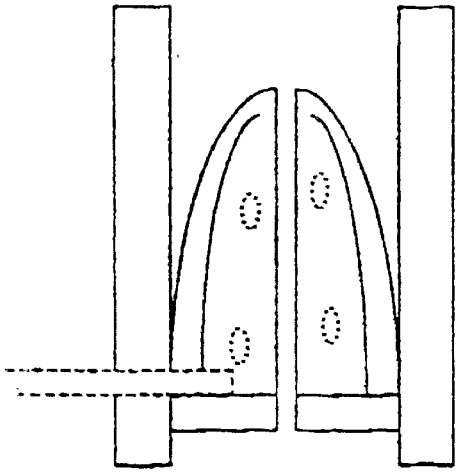
FIGS. 14 to 15 are respective side and plan views of a further embodiment of the venturi.
Figure 15:
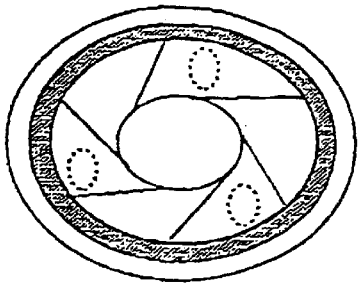

FIGS. 14 and 15 show a sectional side view and top view of the venturi 631 in a jacket and a similar result could be achieved by an expanding or straight line (with angle cuts or holes) pipe design.

In the embodiment of FIGS. 16 and 17, the venturi 731 is an inverted cone-type venturi with holes in the venturi to create the vortex effect. As shown, the venturi 731 may be inverted, with either its tip at the bottom (FIG. 16) or top (FIG. 17) of the chamber in which it is filled.

FIGS. 18 and 19 show a pipe type venturi 831, with holes to create a venturi effect, where the compressed air is fed by the ports 832 to either the chamber in which the venturi 831 is fitted (FIG. 18), or to the venturi 831 itself (FIG. 19).

FIG. 20 is a schematic drawing of a spiral or coil-type venturi 931, where one or more hollow "tubes" are constructed in a spiral type design. As shown in FIGS. 21 to 23, the tube(s) can be cylindrical, rectangular or triangular in cross-section and holes may be provided in a range of locations.

It will be readily apparent to the skilled addressee that pumps in accordance with the present invention have no moving working parts; that by the selection of the number and inclination of the air ports in the venturi, the effective pumping rate of the pump can be varied to suit the particular intended application; and that the only external power source required is a relatively low pressure (but preferably high volume) air compressor (or source of compressed air) which s readily available, eg., on an earth-moving machine or military vehicle, as well as in most factories and manufacturing industries. In addition, the pump does not require filtration of the liquid, unlike most pumps.

The pumps can be used to pump petroleum products, fine powders or granular materials, slurries or other liquids into, or out of, suitable containers.

Various changes and modifications may be made to the embodiments described and illustrated without departing from the present invention.

What is claimed is:

1. A pump for pumping liquids into, or out of, a container, including:

a body;

means to sealably engage the body with an inlet hole of the container;

a liquid passage in the body operably connectable to the interior of the container and to the exterior of the body;

an air passage through the body operably connectable to the interior of the container;

a venturi element in the air passage having a plurality of air ports operable to generate a vortex in the air passage; and compressed air passage means to connect the air ports to a source of compressed air;

the venturi element is movably mounted in the air passage to selectively reverse the air flow through the air passage to either evacuate or pressurize the container, to pump the liquid into, or out of, the container.

2. A pump as claimed in claim 1, wherein:

the venturi element is mounted in a ball, selectively rotatable by a handle.

3. A pump for pumping liquids into, or out of, a container including:

a body;

means to sealably engage the body with an inlet hole of the container, a liquid passage in the body operably connectable to the interior of the container and to the exterior of the body;

an air passage through the body operably connectable to the interior of the container;

a pair of venturi elements in the air passage, each venturi element having a plurality of air ports operable to generate a vortex in the air passage, the venturi elements being arranged to cause respective air flow through the passage in opposite directions; and compressed air passage means to selectively connect the air ports of one of the venturi elements to a source of compressed air;

the venturi elements being selectively connected to the source of compressed air to selectively reverse the air flow through the air passage to either evacuate, or pressurize, the container to pump the liquid into, or out of, the container.

4. A pump as claimed in claim 1 wherein:

float means are provided to close the air passage, and thereby shut off the pump, when the level of the liquid in the container exceeds a preset limit.

5. A pump as claimed in claim 1, wherein:

the venturi element has a plurality of air ports spaced around and/or along the air passage to generate the vortex in the air passage, to generate the air flow through the air passage, and thereby pressurize or evacuate the container.

6. A pump as claimed in claim 5 wherein:

the number and location of the air ports are dependent on the pressure of the compressed air and on the liquids to be pumped.

7. A pump as claimed in claim 6, wherein:

the venturi element is designed to multiply the pressure of the air from the compressed air source, by up to 50–100 times.

8. A pump as claimed in claim 3, wherein:

float means are provided to close the air passage, and thereby shut off the pump, when the level of the liquid in the container exceeds a preset limit.

9. A pump as claimed in claim 3, wherein:

each venturi element has a plurality of air ports spaced around and/or along the air passage to generate the vortex in the air passage, to generate the air flow through the air passage, and thereby pressurize or evacuate the container.

10. A pump as claimed in claim 9, wherein:

the number and location of the air ports are dependent on the pressure of the compressed air and on the liquids to be pumped.

11. A pump as claimed in claim 10, wherein:

the venturi elements are designed to multiply the pressure of the air from the compressed air source, by up to 50–100 times.

* * * * *